US010675676B2

(12) United States Patent
Wannasin et al.

(10) Patent No.: US 10,675,676 B2
(45) Date of Patent: Jun. 9, 2020

(54) PROCESS FOR PREPARING MOLTEN METALS FOR CASTING AT A LOW TO ZERO SUPERHEAT TEMPERATURE

(71) Applicant: GISSCO COMPANY LIMITED, Songkla (TH)

(72) Inventors: Jessada Wannasin, Songkla (TH); C. Merton Flemings, Cambridge, MA (US)

(73) Assignee: GRISSCO COMPANY LIMITED (TH)

( * ) Notice: Subject to any disclaimer, the term of this patent is extended or adjusted under 35 U.S.C. 154(b) by 0 days.

(21) Appl. No.: 15/310,859

(22) PCT Filed: May 16, 2014

(86) PCT No.: PCT/TH2014/000025
§ 371 (c)(1),
(2) Date: Nov. 14, 2016

(87) PCT Pub. No.: WO2015/174937
PCT Pub. Date: Nov. 19, 2015

(65) Prior Publication Data

US 2017/0080484 A1 Mar. 23, 2017

(51) Int. Cl.

| | |
|---|---|
| ***B22D 17/00*** | (2006.01) |
| ***B22D 1/00*** | (2006.01) |
| ***C22C 1/00*** | (2006.01) |
| ***B22D 17/20*** | (2006.01) |
| ***B22D 18/00*** | (2006.01) |
| ***B22D 21/00*** | (2006.01) |

(52) U.S. Cl.
CPC ..... *B22D 1/005* (2013.01); *B22D 1/00* (2013.01); *B22D 1/002* (2013.01); *B22D 17/00* (2013.01);
(Continued)

(58) Field of Classification Search
CPC ..... B22D 1/00; B22D 1/002; B22D 1/005; B22D 17/00; B22D 17/007; B22D 17/08;
(Continued)

(56) References Cited

U.S. PATENT DOCUMENTS 5,836,372 A * 11/1998 Kono ..... B22D 17/007 164/113
6,640,879 B2 11/2003 Richard et al.
(Continued)

FOREIGN PATENT DOCUMENTS

EP 1981668 A2 10/2008
WO WO 9712709 A1 * 4/1997 ..... B22D 17/007
(Continued)

OTHER PUBLICATIONS

International Search Report Dated Feb. 11, 2015 for International Application No. PCT/TH2014/000025, filed May 16, 2014.
(Continued)

*Primary Examiner* — Kevin E Yoon
(74) *Attorney, Agent, or Firm* — Kim IP Law Group PLLC

(57) ABSTRACT

A process for preparing molten metals for casting at a low to zero superheat temperature involves the steps of placing a heat extracting probe into the melt and at the same time vigorous convection is applied to assure nearly uniform cooling of the melt. Then, the heat extraction probe is rapidly removed when a low or zero superheat temperature is reached. Finally, the rapidly cooled melt is quickly transferred to a mold for casting into parts or a shot sleeve for injection into a die cavity. The process may be carried out so as that small amounts of solid form in part of the melt. In this case, a key aspect of the invention is to carry out the process rapidly in order to maintain the particles in a fine, dispersed state that will not impede flow and will improve the quality
(Continued)

of the metal parts produced. Cost of the metal parts produced is lowered due to longer die life and shorter cycle time.

3 Claims, 2 Drawing Sheets

(52) U.S. Cl.
CPC ..... *B22D 17/007* (2013.01); *B22D 17/20* (2013.01); *B22D 18/00* (2013.01); *B22D 21/007* (2013.01); *C22C 1/005* (2013.01)

(58) Field of Classification Search
CPC ..... B22D 17/10; B22D 17/12; B22D 17/20; B22D 18/00
USPC ..... 164/113, 900
See application file for complete search history.

(56) References Cited

U.S. PATENT DOCUMENTS 6,645,323 B2 11/2003 Flemings et al.
6,681,836 B1 1/2004 Sakamoto et al.
6,769,473 B1 * 8/2004 Adachi ..... B22D 17/007 164/113
6,918,427 B2 * 7/2005 Yurko ..... B22D 1/00 164/113
7,237,594 B2 * 7/2007 Czerwinski ..... B22D 17/007 164/113
7,509,993 B1 * 3/2009 Turng ..... B22D 17/007 164/113

FOREIGN PATENT DOCUMENTS

WO 2007092203 A2 8/2007
WO 2007092203 A3 8/2007

OTHER PUBLICATIONS

IPOS Intellectual Property Office of Singapore, Written Opinion dated Jan. 25, 2019, in Singapore Patent Application No. 11201609081P, 5 pages.
IPOS Intellectual Property Office of Singapore, Written Opinion dated May 4, 2018, in Singapore Patent Application No. 11201609081P.

* cited by examiner

PROCESS FOR PREPARING MOLTEN METALS FOR CASTING AT A LOW TO ZERO SUPERHEAT TEMPERATURE

FIELD OF THE INVENTION

This invention relates to a process for preparing molten metals for casting at a low to zero superheat temperature.

BACKGROUND OF THE INVENTION

Several components in the automotive, electrical, agricultural, or toy industries such as alloy wheels, electronic cases, steering wheels, or compressor parts are produced in a high volume by high-pressure die casting, low-pressure casting, or gravity casting processes. In these mass production casting processes, molten metal alloys with a temperature substantially higher than the liquidus temperature are poured and cast. The operation then needs to wait for the casting to fully solidify before it can be removed from the mold or die. To speed up the solidification process, internal cooling by air or water is often applied to the die. In several cases, after the part is removed the surfaces of the die are sprayed by a cooling fluid with a mold release agent. The internal and external cooling processes of the die are used to minimize the cycle time of the process, which helps increase the productivity.

The difference between the pouring temperature and the liquidus or freezing temperature is called 'superheat temperature'. In industrial practice, the superheat temperature is quite high, generally ranging from 80° C. to as high as 200° C. depending on the complexity, size, and section thicknesses of the casting parts. The reasons for having high superheat temperatures in the mass production casting processes are such as (1) to ensure complete filling of the die cavity, (2) to avoid metal buildup in the crucible or ladle due to non-uniform heat loss in the crucible or ladle causing die filling problem and premature solidification of some regions, which causes shrinkage porosity, (3) to allow time for complete directional solidification, which yields parts with little or no shrinkage porosity, and (4) to allow entrapped air bubbles during melt flow to escape before being trapped by solidification.

This high superheat casting processes have been well accepted and generally practiced in mass production. However, the processes lead to several cost disadvantages, which include (1) long cycle time, (2) high energy cost to melt and hold the molten metals, (3) high energy cost for the cooling water, (4) high water treatment cost from die spray, (5) high coolant and die release agent cost, and (6) high reject rates from shrinkage porosity. These disadvantages result in inefficiency of the process and increased production costs.

To solve these problems, several inventions relating to casting in semi-solid state have been proposed such as disclosed in U.S. Pat. Nos. 6,640,879, 6,645,323, 6,681,836, and EP1981668. Semi-solid metal casting involves casting of metals at a temperature lower than the liquidus or freezing temperature with some fractions of solidified solid nuclei. The pre-solidified solid nuclei help reduce turbulent flow problems and shrinkage porosity, resulting in high quality casting parts. However, due to the low casting temperature and high viscosity of the semi-solid metals, the casting processes and the die design need to be modified before the process can be applied successfully. In semi-solid metal casting, a special metal transfer unit may be needed to feed the semi-solid metals into the shot sleeve and then into the die. The die design may also need to be modified to allow complete filling of the semi-solid metals in the die cavity. Normally, thicker gates will be needed with shorter flow distances. Therefore, application of semi-solid metal in the mass production processes requires some time and investment. These semi-solid casting processes are not sufficiently cost effective so they have not been widely applied in the casting industry yet. It is, therefore, the objective of this invention to solve the disadvantages of conventional casting with high superheat temperature and semi-solid metal casting to offer cost savings in the metal casting industries with high production volume by casting molten metals at a low to zero superheat. Even though it is obvious that casting with a low to zero superheat temperature can yield several benefits, the current casting processes cannot simply apply this technique in the mass production. It is not simple to pour and cast the melt with low to zero superheat temperature without any special modifications to the casting process because it is difficult to control the melt temperature to be uniform everywhere in the casting crucible or ladle. In practice, the temperatures of the melt at the wall, center, top and bottom of the casting crucible or ladle are not the same. So, with a low superheat temperature, there is a high risk of forming solidified sheets or skins of metals at locations with the lowest temperatures first. These large skins will then flow with the melt into the die cavity resulting in low fluidity and shrinkage feeding problems. Consequently, this casting process causes defects and part rejects. The solidified skins from the crucible or ladle walls also pose other problems in the production process. If not properly removed, these solidified skins will build up at the wall of the crucible. So, there must be a means or process to remove them, which will increase the production cost. With these problems, it is not practical to cast metals with a low superheat temperature if the process is not properly modified and controlled. Accordingly, it would be desirable have a process which prepares molten metals before casting with low to zero superheat. In certain aspects of this invention, processes are provided to achieve these conditions.

SUMMARY OF THE INVENTION

This invention provides a process for preparing molten metals for casting at a low to zero superheat. The desired conditions of the melt with a low to zero superheat temperature are achieved by agitating the melt with a heat extraction probe inside a melt container. The melt container such as a crucible or ladle is constructed to give a lower rate of heat loss than that of the heat extraction probe. The process comprises the steps of placing a heat extracting probe into the melt, which is initially at a temperature higher than the liquidus temperature, to remove a controlled amount of heat. Then, vigorous convection is applied to the melt to assure nearly uniform cooling of the melt to the temperature at, or very close to the liquidus temperature. A means of obtaining that convection may be by bubbling an inert gas. Injecting the gas to the melt directly from the heat extraction probe is particularly beneficial in assuring uniform cooling of the melt and avoiding solid buildup on the probe. Other forms of agitation such as rotation, stirring, or vibration may also be used. A combination of these convection methods can also be used. Then, the heat extraction probe is rapidly removed from the melt when the desired melt temperature is reached. Finally, the melt is quickly transferred to a mold for casting into parts or a shot sleeve for injection into a die cavity.

In this invention, a small fraction of fine solid nuclei may be created in the melt if the temperature of a portion of the melt is caused to drop below the liquidus. Provided these solid nuclei remain small, the melt can still flow well into the die cavity. When present, the fine solid nuclei bestow other advantages on parts produced according to the teachings of this patent: they (1) provide heterogeneous nucleation sites, which helps yield fine grain structure, (2) reduce shrinkage porosity, which yields less casting reject rate, and (3) to increase slightly the viscosity of the melt, yielding less flow related defects. Small solid metal particles in a metal melt grow rapidly in size due to a phenomenon termed "ripening." Therefore, an important teaching of this patent is that to keep any particles present to a very small size, the process described herein must be carried out rapidly. For example, it is well understood that for a wide range of metallic alloy melts, very small solid particles of the melt (particles 10 microns in diameter or less) grow to about 40 microns in 20 seconds and to about 70 microns in 60 seconds. Therefore, for example in the process described herein, to assure maximum particle size of about 70 microns, it is necessary to perform the steps from probe entry into the melt to the step of the melt transfer into the mold or shot sleeve in less than 60 seconds.

The benefits of this invention in the metal casting industries include die life extension due to exposure to lower temperature, melting energy saving, energy saving of the die cooling process, coolant and mold release agent saving, water treatment saving from the use of less die spray, cycle time reduction which increases the productivity, defect reduction from shrinkage reduction and viscosity increase.

DESCRIPTION OF SPECIFIC EMBODIMENTS

This present invention provides a process for preparing molten metals for casting at low to zero superheat temperature.

By the phrase "low to zero superheat temperature" as used herein are meant that there is at least a part in the melt with the superheat temperature of less than about 5-10 degree Celsius, preferably less than 5 degree Celsius. In some metals and alloys, the superheat temperature may be essentially zero, so that the temperature of the melt in at least one part is at or slightly below the liquidus.

Figure 1:
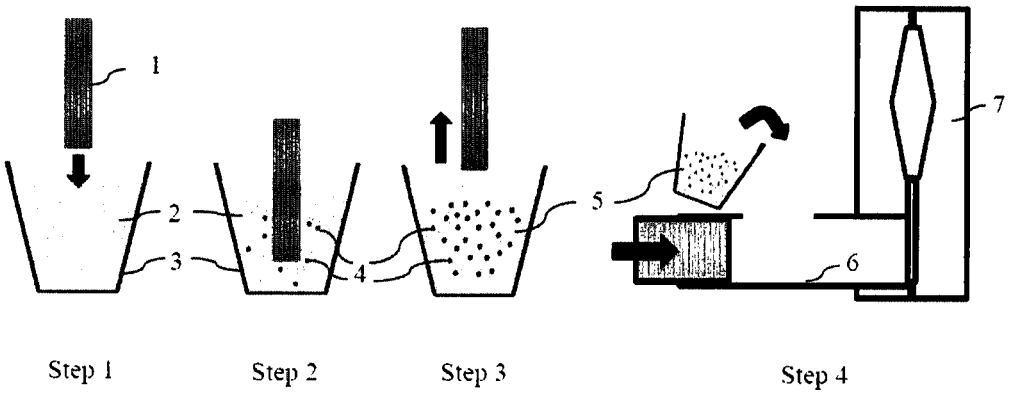
FIG. 1 is a schematic illustration of an apparatus in accordance with an embodiment of the invention.

The process of this invention comprises of four steps illustrated in FIG. 1.

Step 1 starts by placing a heat extracting probe 1 into the melt 2 held inside a container 3 from which heat extraction is low. The melt is initially at a temperature higher than the liquidus temperature, preferably not more than 80 degree Celsius above the liquidus temperature.

In step 2, vigorous convection is applied to the melt to assure nearly uniform cooling of the melt to a low superheat temperature. The convection may be done by various techniques such as injecting inert gas dispensed through the heat extracting probe and creating gas bubbles inside the melt, by vibration, by stirring, by rotation or by a combination thereof. Solid nuclei 4 are progressively formed in the melt.

In Step 3, the heat extraction probe is rapidly removed from the rapidly cooled melt 5 when the desired melt temperature is reached, in order to substantially stop further cooling. The cooling rate of the melt during the probe immersion should be more than 10 degree Celsius per minute. In Step 4, the rapidly cooled melt 5 that has some parts with low to zero superheat temperature is then quickly transferred to a secondary container 6 such as a shot sleeve designed to inject the rapidly cooled melt into a die in die casting process 7 or a mold in gravity casting (not shown). The secondary container 6 or the die or mold for casting purpose needs to be at a lower temperature than that of the melt to stabilize and allow growth of the created solid nuclei.

The time period from entry of the heat extracting probe into the melt to entry of the metal into the mold should be less than about 60 seconds to ensure that the solid nuclei are fine in size for the desired flow behavior into the die cavity. A cleaning process may be added to ensure no solid sticking on the heat extracting probe after each process cycle.

Figure 2:
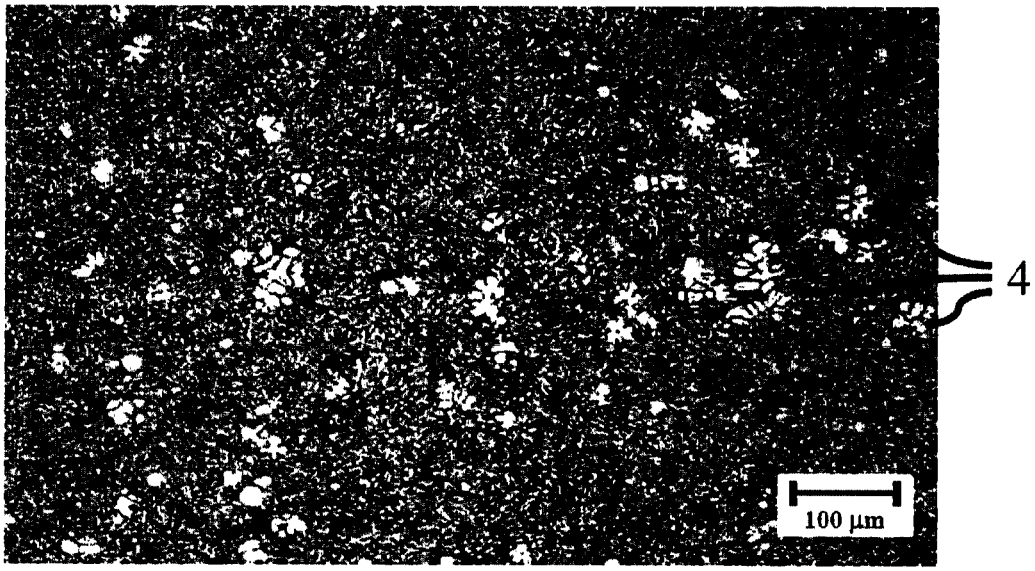
FIG. 2 is an optical micrograph of the rapidly cooled melt with near zero superheat temperature showing a small fraction of finely distributed solid nuclei in the matrix of the rapidly solidified melt.

Shown in FIG. 2 is the microstructure of a rapidly cooled aluminum melt at a low superheat temperature. The optical micrograph shows a small fraction of bright particles uniformly dispersed in the matrix. These bright particles are the solid nuclei 4 created during the heat extracting probe immersion (Step 2 of FIG. 1). These solid nuclei 4 are very fine in size, in the order of less than 100 micron in diameter. To create a large number of these fine solid nuclei, it is necessary to create it in a short time. Therefore, the heat extracting probe immersion time should be less than 30 seconds, preferably less than 15 seconds.

The following two examples illustrate two embodiments of the present invention. Other embodiments of the invention will be apparent to those skilled in the art from a consideration of the specification or practice of the invention disclosed herein.

Example 1

High-Pressure Die Casting of an Aluminum Alloy

The following is a description and the benefits of casting molten metals at a low superheat temperature and with a small fraction of fine solid nuclei in the melt in a high-pressure die casting process of an Al—Mg alloy part.

In this example, the Al—Mg alloy has the liquidus temperature of about 640° C. In the current commercial liquid casting process, the pouring temperature of the alloy into the shot sleeve of a high-pressure die casting machine is about 740° C. (the superheat temperature of about 100° C.).

By applying the present invention to the current commercial production process, the key motivations are to improve the productivity, reduce production cost, and extend the die life. In this example, the Al—Mg alloy is treated with a heat extraction probe in the ladle at the temperature of about 660° C. for 2 seconds. The vigorous convection is achieved by flowing fine inert gas bubbles through a heat extracting probe such as a porous probe at the flow rate of 2-10 liter/minute. For each cycle of the probe immersion into the molten metal, the temperature of the probe is controlled to be nearly the same in the range of 50° C. to 150° C. After the treatment, the melt temperature is reduced to about 645° C., which is about 5° C. above the liquidus temperature (the superheat temperature of about 5° C.) with a fraction of solid estimated to be under about 3-5% by weight. The melt is then quickly transferred into the shot sleeve in less than 10 seconds and then injected into the mold in less than 3 seconds. The total time from entry of the probe into the melt to entry of the metal into the mold is about 15 seconds.

Results of the mass production process with the present invention show several expected benefits, including reduction in usage of natural gas for melting aluminum by about 25%, reduction in die holding time by 40%, reduction in die spray time by 40%, and die life extension by more than 2 times, and reduction of casting reject from 30% to 5%.

Example 2

Gravity Die Casting of an Aluminum Alloy

The following is a description and the benefits of casting molten metals at a low superheat temperature and with a small fraction of fine solid nuclei in the melt in a gravity die casting process of an Al—Si—Mg alloy component.

In this example, an Al—Si—Mg alloy is cast into a metal die. This alloy has the liquidus temperature of about 613° C. The die is preheated to about 400° C. before each casting cycle. The conventional liquid casting process pours the molten metal alloy at about 680° C. (the superheat temperature of about 67° C.). With the present invention, the casting temperature is lowered to about 614° C., about 1° C. above the liquidus temperature (the superheat temperature of about 1° C.). In this example, the melt is treated with a heat extraction probe in the ladle at the temperature of about 630° C. for about 5 seconds. The vigorous convection is achieved by flowing fine inert gas bubbles through a heat extracting probe such as a porous probe at the flow rate of 2-10 liter/minute. For each cycle of the probe immersion into the molten metal, the temperature of the probe is controlled to be nearly the same in the range of 50° C. to 150° C. The melt is then quickly transferred and poured into the mold in less than 12 seconds. The total time from entry of the probe into the melt to entry of the metal into the mold is about 17 seconds. Results show that the present invention yields better mechanical properties. The liquid casting process with the superheat temperature of 67° C. gives the ultimate tensile strength of 287 MPa and the elongation of 10.5%. The casting process with the present invention gives the ultimate tensile strength of 289 MPa and the elongation of 11.2%. The productivity of the casting process using the present invention is also higher. This is because the freezing time of the melt in the mold is reduced from 133 seconds for the conventional liquid casting with the high superheat temperature of 67° C. to 46 seconds for this invention with near zero superheat temperature. This shows that the die opening time in the production process can be reduced by about 65%.

Another key benefit of this present invention is the saving of the melting energy. With the present invention, the holding temperature of the furnace can be reduced by about 100° C. This reduction can significantly save the energy and extend the furnace life.

The above description is considered that of the preferred embodiments only. Modifications of the invention will occur to those stilled in the art and to those who make or use the invention. Therefore, it is understood that the embodiments described above are merely for illustrative purposes and not intended to limit the scope of the invention, which is defined by the following claims as interpreted according to the principles of patent law, including the doctrine of equivalents.

The invention claimed is:

1. A method for preparing molten metals for casting at low superheat temperatures, said method comprising:

(a) having a melt of a metal or alloy that is initially at a superheat temperature above the liquidus temperature of the metal or alloy in a container;

(b) decreasing the temperature of the metal or alloy at a rate of more than 10° C. per minute by placing at least one heat extracting probe into the melt to remove a controlled amount of heat and applying vigorous convection to the melt to assure nearly uniform cooling of the melt, wherein the vigorous convection is applied via bubbling an inert gas through the heat extracting probe through a multiplicity of gas outlets, thereby forming a semi-solid slurry of the metals, wherein the inert gas is provided at a flow rate of 2 to 10 liters per minute for less than 30 seconds;

(c) removing the heat extracting probe from the cooled melt when the temperature of the metal or alloy is at a lower superheat temperature above the liquidus temperature and the fraction of solid nuclei formed in the slurry is about 3-5% by weight, in order to substantially stop further cooling, wherein the lower superheat temperature is maximally 5° C. above the liquidus temperature; and (d) transferring the cooled melt at a temperature above the liquidus temperature into a secondary container for casting in a time-regulated manner wherein the time period from the entry of the heat extracting probe into the melt to entry of the cooled melt into the secondary container is less than 60 seconds to ensure that the solid nuclei has a size of less than 70 microns in diameter for desired flow behavior.

2. The method of claim 1, wherein the container is in the form of a crucible or ladle, which is made of a material and is at a temperature such that the container extracts heat from the melt at a significantly lower rate than does the heat extracting probe.

3. The method of claim 1, wherein said metal or alloy includes a component selected from the group consisting of aluminum, silicon, and magnesium.

* * * * *